United States Patent [19]

Cowardin

[11] 4,252,218

[45] Feb. 24, 1981

[54] DEVICE AND METHOD FOR UNLOCKING ELEVATOR DOORS

[76] Inventor: David H. Cowardin, P.O. Box 86, Orange, Calif. 92666

[21] Appl. No.: 3,306

[22] Filed: Jan. 15, 1979

[51] Int. Cl.[3] ..... B66B 13/00

[52] U.S. Cl. ..... 187/61; 70/465

[58] Field of Search ..... 187/61, 56, 57, 51; 81/3 R; 70/465

[56] References Cited

U.S. PATENT DOCUMENTS

| | | | |
|---|---|---|---|
| 885,924 | 4/1908 | Hollinger | 187/61 |
| 1,245,946 | 11/1917 | Moul | 187/57 |
| 2,350,250 | 5/1944 | Pietrobon | 70/465 |
| 2,885,917 | 5/1959 | Smith | 81/3 R |
| 4,048,873 | 9/1977 | Stevens | 81/3 R |

*Primary Examiner*—Robert J. Spar
*Assistant Examiner*—Kenneth Noland
*Attorney, Agent, or Firm*—Willie Krawitz

[57] ABSTRACT

A device and method for unlocking elevator doors from the outside comprises a flexible metal rod having a handle, two arms, a rectangular, "U"-shaped portion formed by the arms, and an unlocking finger remote from the handle.

4 Claims, 8 Drawing Figures

Fig. 1
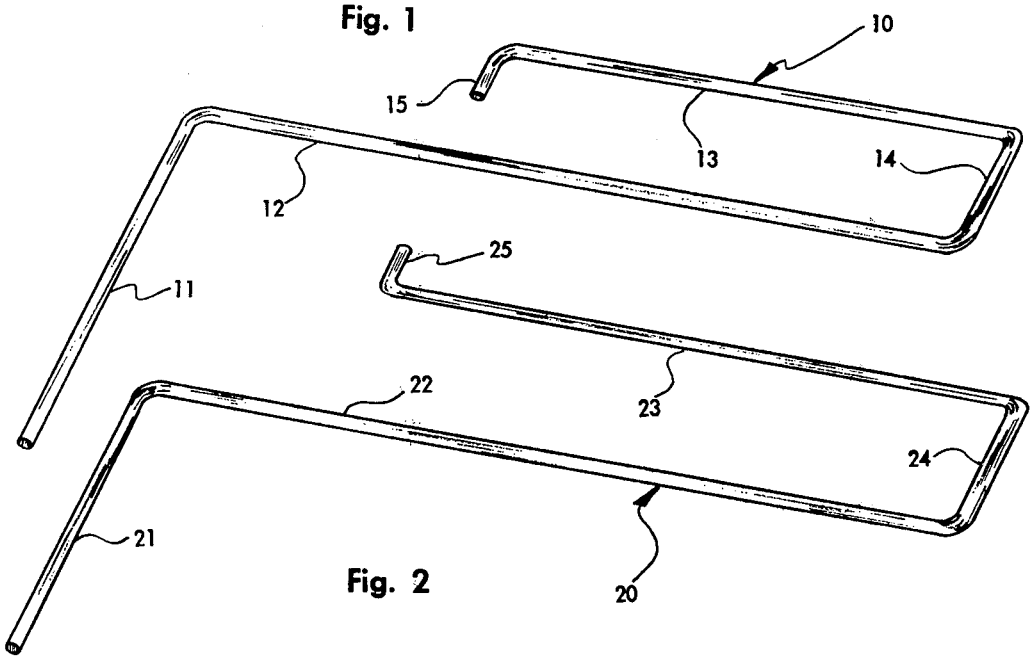
Fig. 2
Fig. 3
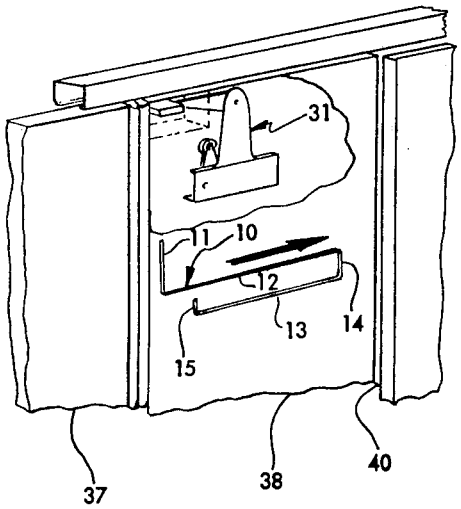
Fig. 4
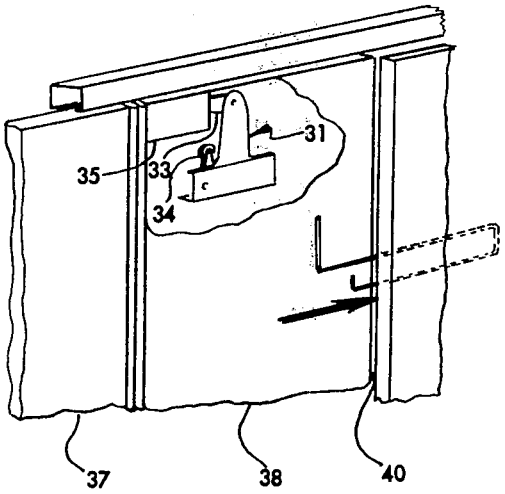

DEVICE AND METHOD FOR UNLOCKING ELEVATOR DOORS

BACKGROUND OF THE INVENTION

This invention relates to a device and method for unlocking elevator doors.

Conventional passenger elevators are subject to deactivation due to power failure, circuit problems, etc., and when this occurs, the elevator will frequently stall between floors or become immobilized at a floor level. Usually, lock mechanisms are specifically designed to prevent door opening during normal operations, and hence, when a power failure or other similar occurrence causes an elevator interruption, it becomes quite difficult to unlock the mechanism and open the door.

However, it is frequently very important to open the elevator doors quickly because of panic and health problems, or because of the occasional necessity for an emergency evacuation from a building itself.

One problem associated with many unlocking tools is that when inserted obliquely through an opening, and thrust forward to a catch or lock, etc., the oblique entry causes the tool to angle away from the lock; this makes it quite awkward to contact and manipulate the lock.

An inexpensive device for unlocking elevators is desired which is easy to operate without requiring expert skills; also, the device should be designed to unlock an elevator quickly. The device sould be sufficiently simple so that it does not require servicing, and a device having no moving parts which can readily stored for easy access is preferred.

THE INVENTION

According to the invention, a device for unlocking elevators, and a method therefor is provided having approximately a rectangular "U"-shaped form, the device having an elongate portion with a handle at one end thereof; a "U"-shaped portion at its other end; and, an unlocking finger integral with, and at the end remote from the handle. Preferably, all elements of the device, i.e. elongate portion, handle, "U"-portion, and unlocking finger are coplanar. The configuration of the device is such that it can be reversibly inserted into an elevator at almost 180° to the door surface, retracted to the closed position of the "U", and then manipulated to open the lock with the finger. Since the handle and unlocking finger are relatively close to each other vis' a vis' the lock, it is easy to manipulate the handle to effect a corresponding movement of the finger. With practice, most elevators which may be unlocked include Otis, Westinghouse, Dover, U.S. Elevator, Coast, Haughton, etc. Typical mechanisms which may be unlocked are manufactured by Otic, Westinghouse, GAL Corp., Elevator Research, etc.

BRIEF DESCRIPTION OF THE DRAWINGS

FIGS. 1 and 2 show two different forms of the unlocking device according to the invention; and, FIGS. 3–8 illustrate, sequentially operation of the device to effect entry into an elevator and to unlock the lock mechanism.

DESCRIPTION OF THE PREFERRED EMBODIMENT

Figure 5:
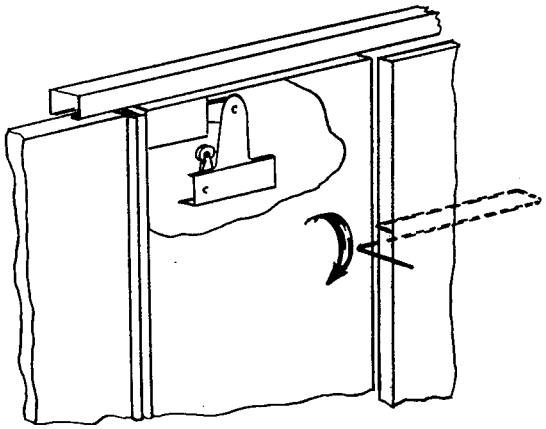
Figure 6:
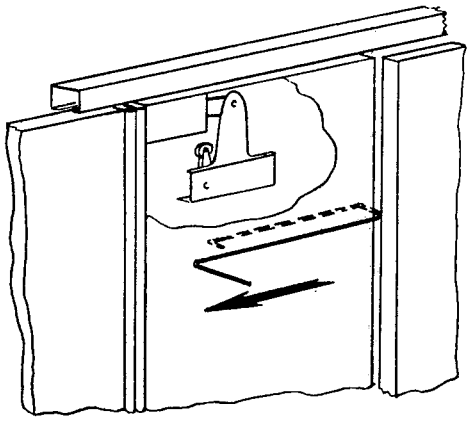
Figure 7:
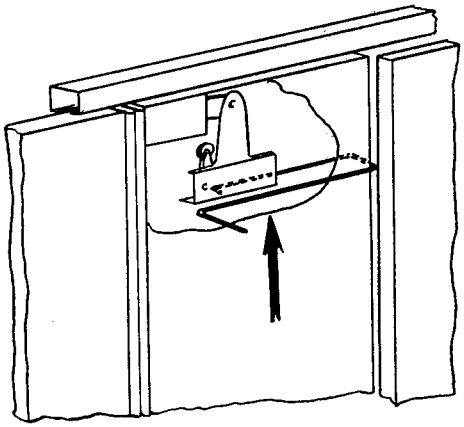

FIGS. 1 and 2 illustrate two somewhat different forms of the unlocing device of this invention, both having similar configurations, with each embodiment being adapted for different forms of roller cam interlocking elevator locks.

The unlocking device 10 shown in FIG. 1 is employed for Otis elevator interlocks and generally will operate solely on center opening doors, two speed doors, and two speed, center opening doors. The device comprises a handle 11, arms 12 and 13 which form a rectangular, "U"-shaped portion 14, and an inwardly extending, unlocking finger 15. The unlocking device is made of a good quality steel rod which will not permanently deform when in use. Preferably, the individual elements, i.e. the handle, arms, "U"-shaped portion, and unlocking finger are all coplanar, and this makes the device easier to manipulate when opening an interlock.

FIG. 2 illustrates a somewhat different unlocking device 20 of the invention which is employed for roller cam interlocks other than the Otis type. The device 20 comprises a handle 21, arms 22 and 23 which form a rectangular, "U"-shaped portion 24, and an outwardly extending finger 25. Occasionally, it may be necessary to bend the arm 23 inwardly for opening single slide doors on both the Otis and other type of interlocks.

Figure 8:
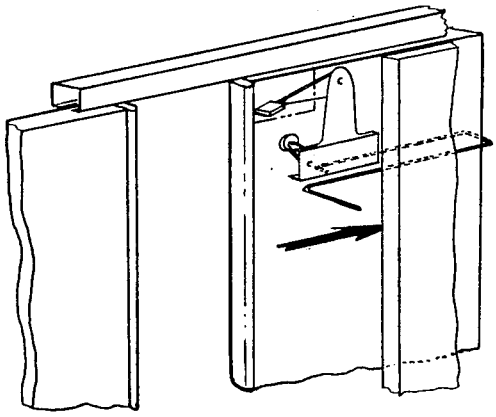

Operating the unlocking device of FIG. 1 is illustrated in FIGS. 3 to 8, the elevator and interlock 31 being an Otis type, with one portion of the interlock 31 being shown mounted for movement on the elevator door. The interlock provides a contact plate 33 actuated by a mechanical lever 34 which enters a contact box 35 to complete a safety closure circuit, not shown. In the running mode, when the circuit is completed, the doors will remain mechanically locked and the car will be free to run. If the circuit is broken, the car will be immobilized and the inner elevator doors 37, 38 will be maintained closed. However, as shown in FIG. 8, when the actuating lever 34 is moved forward, the contact plate is lowered and this releases the interlock so that it can be moved along with the door. Consequently, the elevator doors 37, 38 may be opened.

A shown in FIG. 3, the opening device 10 shown in FIG. 1 initially is placed flatside along the door with the handle 11 upwards; the device is then moved along the outside of the doors 37, 38 in the direction of the arrow.

In FIG. 4, the device, still oriented flatside, is moved further in the direction shown by the arrow and inserted through the inner door.

In FIG. 5, the device is rotated from its flatside orientation to a horizontal orientation and retracted (FIG. 6) so that the "U"-shaped portion 14 contacts the door end. The device is then elevated in FIg. 7 to its operating position and manipulated (FIG. 8) so that the mechanical lever 34 is tripped forward to permit the doors to be opened.

The opening device 20 shown in FIG. 2 is designed to open center opening doors, two speed doors and two speed center opening doors with interlocks other than of the Otis type; these three types of interlocks function in a somewhat similar fashion to the Otis.

It will be appreciated from FIG. 4 and FIG. 5 that the configuration of the present device 10 permits insertion between the door and retraction toward the interlock with very little change from the approach angle. Consequently, movement of the device to contact the interlock is almost at 180°, and this facilitates its operation. Since the elements of the device are coplanar, the unlocking finger 15 and handle 11 are both at the same height relative to the lock, and this makes it easy to manipulate the interlock itself.

Finally, despite the differences in the interlocks on which they are designed to operate, both forms of the unlocking device of FIG. 1 and FIG. 2 are very similar in configuration, and this makes their manufacture less expensive. Also, the similarity of both devices makes it easier to teach their use and to actually use them.

I claim:

1. A device for opening an elevator lock from the exterior of a stalled or immobilized elevator, when the elevator is stationary, to permit opening of a closed, slidable, elevator door, comprising:

(a) a flexible, generally U-shaped rod member providing an outwardly extending handle at one end, and which extends perpendicularly from the U-shaped rod member, the U-shaped portion being located medially of the device;

(b) an unlocking finger at an end remote from the handle and extending perpendicularly from the U-shaped rod member;

(c) two arms positioned at right angles to each other forming the U-shaped portion, the handle being integral with one arm at its end, and the unlocking finger being integral with the other arm and at an end remote from the handle, the arms, handle, U-shaped portion and unlocking finger being coplanar to each other;

the device at the finger end being:

i. inserted at about 180° between the closed doors of an elevator; ii. said device then being retracted along the closed elevator door at its inside until the unlocking finger coincides with the elevator lock; and, iii. manipulation of the finger to open the lock, the extend of retraction of the unlocking finger to coincide with the lock being determined by contact of the bight portion of the U-shaped portion and the elevator door.

2. The device of claim 1, in which the device at the finger end is: a. inserted vertically flatwise between the closed doors and at about 180°; b. rotated 90° from the vertical orientation to a horizontal position; c. retracted until the bight portion of the U-shaped portion contacts the elevator door; and, d. elevated to the lock for manipulation by the unlocking finger to open the lock.

3. A method for opening an elevator lock with an unlocking device from the exterior of a closed elevator when the elevator is stalled or immobilized to permit opening of a closed, slidable elevator door, the device comprising:

a. a flexible, generally U-shaped rod member providing an outwardly extending handle at one end, and which extends perpendicularly from the U-shaped rod member, the U-shaped portion being located medially of the device;

b. an unlocking finger at an end remote from the handle and extending perpendicularly from the U-shaped rod member;

c. two arms positioned at right angles to each other forming the U-shaped portion, the handle being integral with one arm at its end, and the unlocking finger being integral with the other arm and at an end remote from the handle, the arms, handle, U-shaped portion and unlocking finger being coplanar to each other;

the method comprising the steps of:

i. inserting the device at the finger end at about 180° between the closed doors of the elevator;

ii. retracting the device along the closed elevator door at its inside until the unlocking finger coincides with the elevator lock; and iii. manipulating the finger to open the lock, the extent of retraction of the unlocking finger to coincide with the lock being determined by contact of the bight portion of the U-shaped portion and the elevator door.

4. The method of claim 3, comprising the steps of:

i. inserting the device vertically flatwise between the closed doors of the elevator at the finger end, and at about 180°;

ii. rotating the device 90° from the vertical orientation to a horizontal position;

iii. retracting the device until the bight portion of the U-shaped portion contacts the elevator door; and iv. elevating the device to the lock for manipulation by the unlocking finger to open the lock.

* * * * *